US006920987B2

(12) United States Patent
Siegel et al.

(10) Patent No.: US 6,920,987 B2
(45) Date of Patent: Jul. 26, 2005

(54) TILTABLE KNIFE HOLDER

(75) Inventors: Jeffrey Siegel, Kings Point, NY (US); Robert Reichenbach, Scarsdale, NY (US)

(73) Assignee: Lifetime Hoan Corporation, Westbury, NY (US)

( * ) Notice: Subject to any disclaimer, the term of this patent is extended or adjusted under 35 U.S.C. 154(b) by 101 days.

(21) Appl. No.: 10/420,292

(22) Filed: Apr. 22, 2003

(65) Prior Publication Data

US 2004/0211737 A1 Oct. 28, 2004

(51) Int. Cl.[7] ..... A47F 7/00

(52) U.S. Cl. ..... 211/70.7; 211/4; 211/70.6; 211/1.3; 211/170; 248/37.3; 30/298.4; 70/61

(58) Field of Search ..... 211/70.7, 70.6, 211/170, 1.3, 4; 248/37.3, 37.6; 30/298.4, 326; 206/372; 70/58.61

(56) References Cited

U.S. PATENT DOCUMENTS

| | | | | | |
|---|---|---|---|---|---|
| 3,337,058 | A | * | 8/1967 | Sandrick | 211/69 |
| 3,578,153 | A | * | 5/1971 | Olson | 206/379 |
| 3,889,809 | A | | 6/1975 | McNair | 206/372 |
| 4,082,386 | A | * | 4/1978 | Beasley, Jr. | 312/204 |
| 4,374,565 | A | * | 2/1983 | Neumann | 211/69.5 |
| 4,492,028 | A | * | 1/1985 | Bourgein | 30/298.4 |
| 4,537,315 | A | * | 8/1985 | Griffin | 211/70.6 |
| 4,601,400 | A | * | 7/1986 | Buchanan et al. | 211/70.7 |
| 5,245,756 | A | | 9/1993 | Howell et al. | 30/298.4 |
| 5,725,108 | A | * | 3/1998 | Olson | 211/70.7 |
| 6,047,830 | A | * | 4/2000 | Chang | 206/576 |
| 6,581,774 | B1 | * | 6/2003 | Galafassi et al. | 206/553 |
| D494,023 | S | * | 8/2004 | Siegel et al. | D7/637 |
| 6,854,186 | B2 | * | 2/2005 | Basden et al. | 30/298.4 |
| 2003/0041632 | A1 | | 3/2003 | Del Nin | 70/93 |

* cited by examiner

*Primary Examiner*—Robert W. Gibson, Jr.
(74) *Attorney, Agent, or Firm*—Jenkens & BGilchrist, P.C.

(57) ABSTRACT

A knife holder is disclosed. The knife holder includes a housing and a block portion for holding one or more knives. The block portion is pivotally attached to the housing such that the block portion may be moved between an upright position in which the block portion is substantially within the housing, and an extended position in which the block portion extends from the housing so that knives may be easily withdrawn therefrom. The knife holder may further include a locking mechanism operatively coupled to the knife block, for selectively locking the knife block in the upright position so that knives cannot be easily withdrawn therefrom.

31 Claims, 4 Drawing Sheets

TILTABLE KNIFE HOLDER

BACKGROUND OF THE INVENTION

1. Technical Field of the Invention

The present invention relates to a knife block, and particularly to a selectively tiltable knife block.

2. Description of the Related Art

Knife blocks are known for storing knives. Conventional knife blocks include a plurality of slots in which knife blades may be inserted. Knife handles typically extend from conventional knife blocks for ease in withdrawing the knives therefrom.

Despite there being numerous different knife blocks, a need exists for a knife block that efficiently and conveniently stores knives and includes a lock safety feature so that children cannot access the stored knives.

SUMMARY OF THE INVENTION

Embodiments of the present invention satisfy a significant need for a knife holder that efficiently holds knives when not in use and presents the stored knives from being easily withdrawn. According to an exemplary embodiment of the present invention, the knife holder includes a block member having at least one slot disposed along a top surface thereof for receiving a portion of a knife therein. The knife block may also include a housing member to which the block member is pivotally attached along a transverse pivot axis so that the block member may be moved between an upright position in which the top surface of the block member is positioned substantially within the housing and an extended position in which the top surface of the block member extends from the housing at a predetermined angle. When the knife block is in the upright position, knives cannot be easily withdrawn.

The knife block may further include a lock mechanism having an actuator coupled to the block member such that manipulating the actuator by finger applied pressure selectively locks the block member in the upright position. Because knives cannot be easily removed from the knife block when the block member is in the upright position, the lock mechanism advantageously prevents a child from accessing the stored knives.

The knife block may still further include an opening mechanism that provides for a smooth and controlled movement of the block member from the upright position to the extended position. The opening mechanism may include a latch member that is disengaged by moving the front of the block member slightly inwardly, relative to the housing. Thereafter, the block member is urged outwardly from the upright position by a hydraulic member until the block member is in the extended position. The block member may be subsequently returned to the upright position by urging the block member inwardly until the latch member engages the block member and holds the block member in the upright position.

BRIEF DESCRIPTION OF THE DRAWINGS

A more complete understanding of the system and method of the present invention may be obtained by reference to the following Detailed Description when taken in conjunction with the accompanying Drawings wherein.

DETAILED DESCRIPTION OF THE EXEMPLARY EMBODIMENTS

The present invention will now be described more fully hereinafter with reference to the accompanying drawings in which exemplary embodiments of the invention are shown. This invention may, however, be embodied in many different forms and should not be construed as being limited to the embodiments set forth herein. Rather, the embodiments are provided so that this disclosure will be thorough and complete, and will fully convey the scope of the invention to those skilled in the art.

Figure 1:
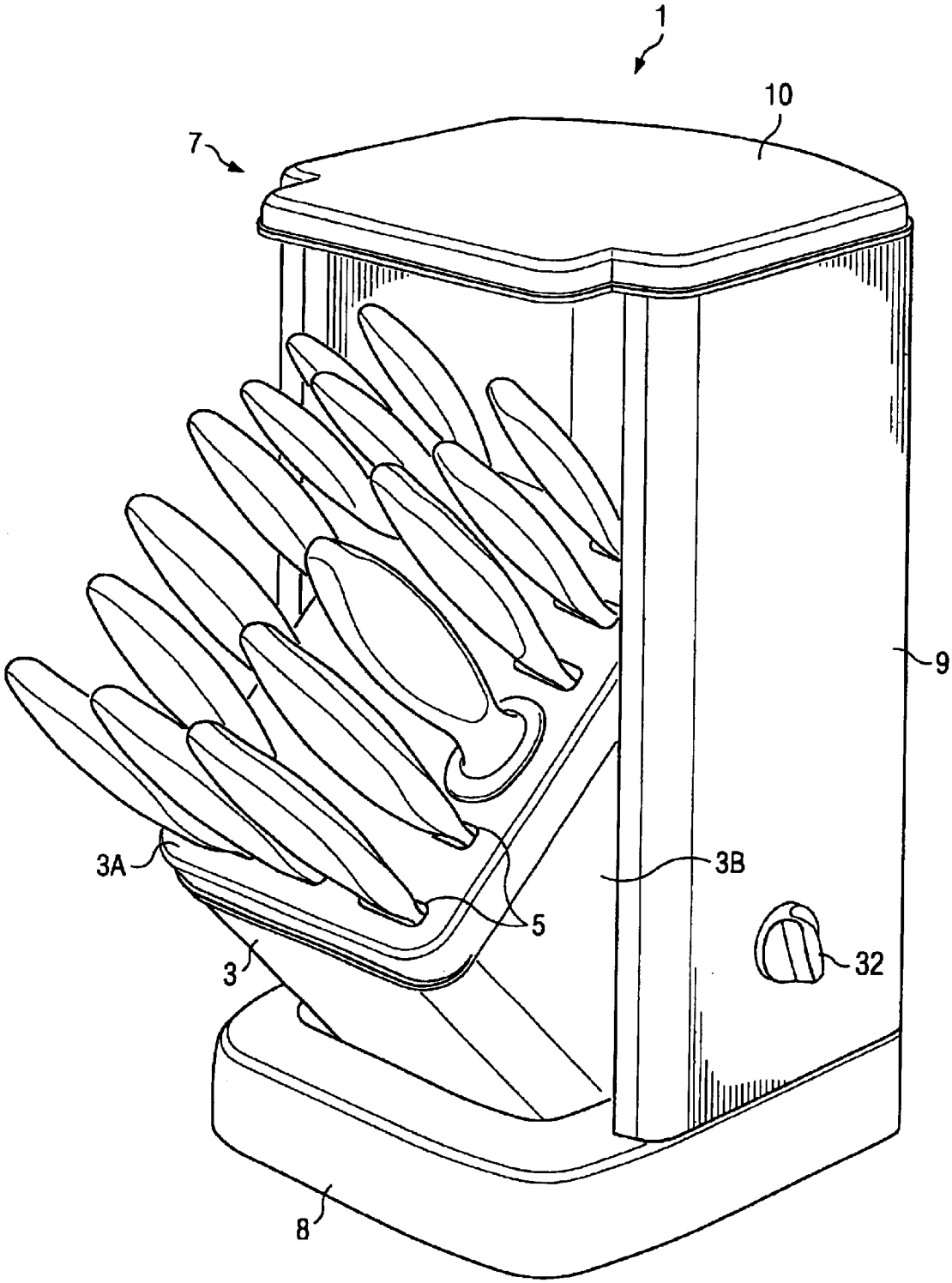
FIG. 1 is a perspective view of a knife block according to an exemplary embodiment of the present invention.
Figure 2:
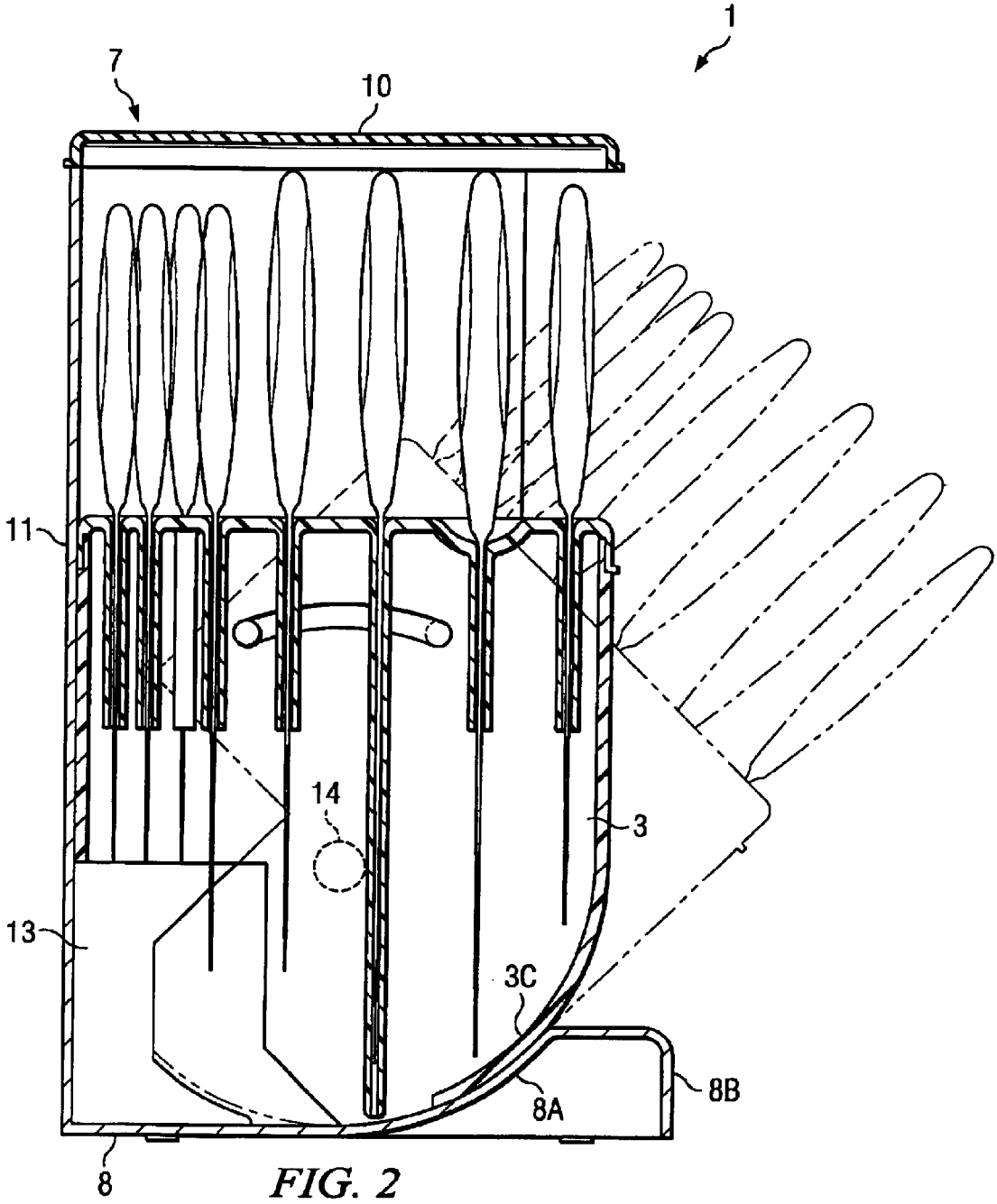
FIG. 2 is a cross-sectional side view of the knife block of FIG. 1.

Referring to FIGS. 1–6, there is shown a knife block 1 according to an exemplary embodiment of the present invention. Knife block 1 is adapted for efficiently storing knives as well as presenting the knives for convenient withdrawal. Knife block 1 may include a block member 3 having one or more slots 5 defined therein for storing one or more knives. Slots 5 may be defined from a top surface 3A of block member 3 and extend into block member 3. Slots 5 may have different widths and lengths to accommodate knives of different sizes. Slots 5 may be arranged, for example, along top surface 3A of block member 3 in rows and columns so that as many knives as possible may be stored in knife block 1. Top surface 3A of block member 3 my have a substantially rectangular or square shape. It is understood, however, that top surface 3A may have other shapes. Block member 3 may include sides 3B as well as a bottom 3C (FIG. 2). Bottom portion 3C may have a curved, substantially rounded, convex surface.

Knife block 1 may further include a housing 7 to which block member 3 is pivotally attached. Housing 7 is sized and shaped to substantially house and/or contain block member 3 when block member is in an upright position in which stored knives are substantially vertical, and to allow top surface 3A of block member 3 to extend from housing 7 when block member 3 is in an extended position in which stored knives are positioned at an angle between the vertical and horizontal. Housing 7 may include a base 8, sides 9, a top or cover 10 and back 11.

Base 8 has a substantially flat lower surface. As shown in FIG. 2, base 8 may have a curved, substantially rounded, concave upper surface 8A that is shaped to substantially coincide with the curved, convex surface of bottom portion 3C of block member 3. The concave upper surface 8A of base 8 and the matching convex surface of bottom portion of 3C of block member 3 allow for block member 3 to be rotated between the upright and extended positions. A front portion 8B of base 8 may extend sufficiently upwardly so that the bottom portion 3C of block member 3 is substantially hidden from a front view of knife block 1.

Sides 9 of housing 7 may be connected to opposed sides of base 8. Back 11 may be connected between sides 9. Cover may be connected to sides 9 and back 11. Cover 10 may be sized so as to cover or otherwise be positioned substantially entirely over block member 3 when block member 3 is in the upright position. When in the upright position, block member 3 is contained within the inner area defined by base 8, cover 10, sides 9 and back 11. The clearance between cover 10 and the top of handles of knives stored in knife block 1 when block member 3 is in the upright position is such that stored knives cannot be withdrawn.

Base 8, cover 10, sides 9 and back 11 may be formed of a substantially rigid material, such as a metal composition. It is understood, however, that base 8, cover 10, sides 9 and back 11 may be constructed from rigid materials other than metal. It is further understood that some of base 8, cover 10, sides 9 and back 11 may be formed from one material and other of base 8, cover 10, sides 9 and back 11 may be formed from another material.

Housing 7 may include a weight member 13 (FIG. 2) disposed in a rearward portion of knife block 1 that serves as a counterbalance to maintain housing 7 in a stable position when block member 3 is in the extended position. Weight member 13 is beneficial in providing a stable knife block given the size and weight of knife handles that may extend from block member 3. Weight member 13 may be connected to a rearward portion of block member 3 or housing 7.

As stated above, block member 3 is pivotally engaged with housing 7. Specifically, knife block 1 may include a pivot axle 14 which defines an axis about which block member 3 selectively rotates. The rotational axis formed by pivot axle 14 may be transverse to the exposed front surface of block member 3. In an exemplary embodiment of the present invention, pivot axle 14 is affixed to housing 7 and block member 3 freely rotates about pivot axle 14. In this way, block member 3 is capable of being tilted from the upright position to the extended position.

Knife block 3 may include a lock mechanism 30 to lock block member 3 in the upright position. As stated above, there is provided little clearance between the top 10 of housing 7 and the top of the handles of knives stored in knife block 1 when block member 3 is in the upright position, such that withdrawal of knives cannot occur. By providing a lock that maintains block member 3 in the upright position when activated, knife block 3 provides a child safety type of function.

Figure 3:
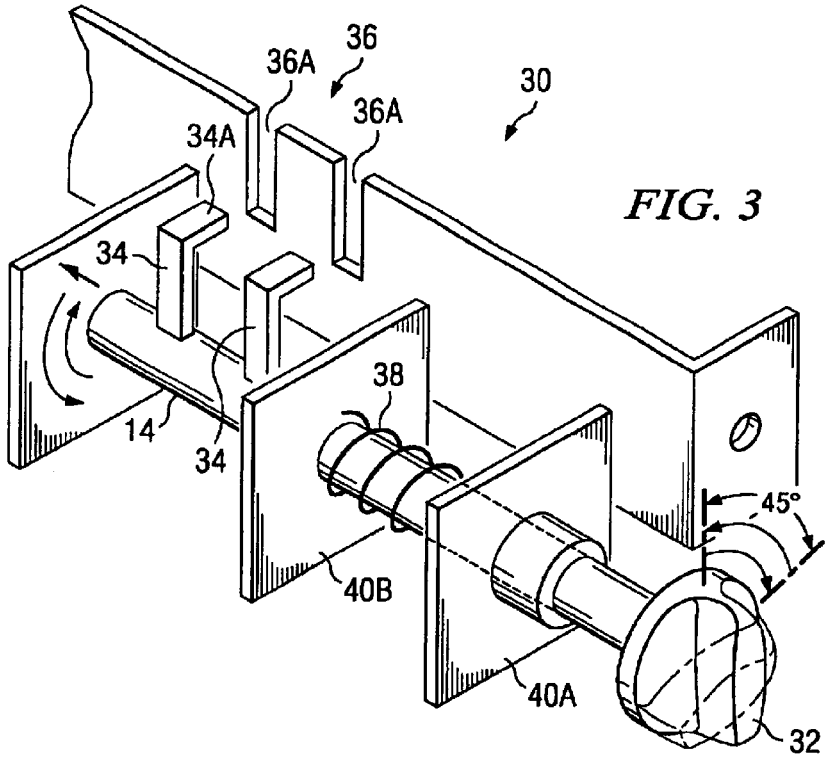
FIG. 3 is a perspective view of a lock mechanism of the knife block of FIG. 1.

With reference to FIG. 3, lock mechanism 30 may be operatively engaged with pivot axle 14. In particular, lock mechanism 30 may include an actuator 32 that is connected to axle 14 such that rotation of actuator 32 causes pivot axle 14 to rotate. Lock mechanism 30 may further include one or more post members 34 which are connected to pivot axle 14 and extends radially outwardly therefrom. Each post member 34 may have an inverted L-shape and thereby may include a tab portion 34A disposed from a free end of post member 34. A bracket member 36 may be affixed to block member 3 at an inner, rearward portion thereof, in relatively close proximity to pivot axle 14. Bracket member 36 may include a slot 36A for each post member 34. Each slot 36 may be sized, shaped and positioned along bracket member 36 so that the tab portion 34A of a corresponding post member 34 may engage therewith. Rotation of actuator 32 by hand-applied pressure, which in this case is clockwise rotation as shown in FIG. 3, causes post member(s) 34 to rotate about pivot axle 14 until each tab portion 34A engages with a corresponding slot 36A. Engagement of post member (s) 34 with slot(s) 36A prevents rotational movement of actuator 32 in either rotational direction. When post member (s) 34 is engaged with bracket 36, bracket 36 and block member 3 are anchored in place and are therefore unable to rotate.

In an exemplary embodiment of the present invention, actuator 32 may be moved inwardly in order for post member(s) 34 to be aligned with slot(s) 36A. Further, lock mechanism 30 may include a spring member 38 disposed between plates 40 and in substantial coaxial alignment with pivot axle 14. One of the plates 40A may be affixed to pivot axle 14 and the other plate 40 may be affixed to housing 7. In this way, inward movement of actuator 32 causes plate 40A to be moved closer to plate 40B and spring member 38 to be compressed. When actuator 32 is no longer forced inwardly, spring member 38 expands which forces plate 40A away from plate 40B, which thereby forces actuator 32 outwardly.

As shown in FIG. 3, each slot 36A is substantially rectangular shaped, but it is understood that slot(s) 36A may be other shapes so that it is more difficult to disengage a post member 34 therefrom. For instance, each slot 36 may be substantially L-shaped when viewed from the front of knife block 1. In this way, manipulation of actuator 32 may be more complex in order to disengage post member(s) 34 from slot(s) 36.

It is understood that additional anchoring of block member 3 may be included by anchoring block member 3 to the base 8 of housing 7. This additional anchoring would also be activated by manipulation of actuator 32.

Knife block 1 may further include an open/close mechanism for selectively latching block member 3 in the upright position and for selectively moving block member 3 from the upright position towards the extended position. In the exemplary embodiment of the present invention, the open/close mechanism may move block member 3 towards the extended position in a relatively slow, controlled manner.

Figure 4:
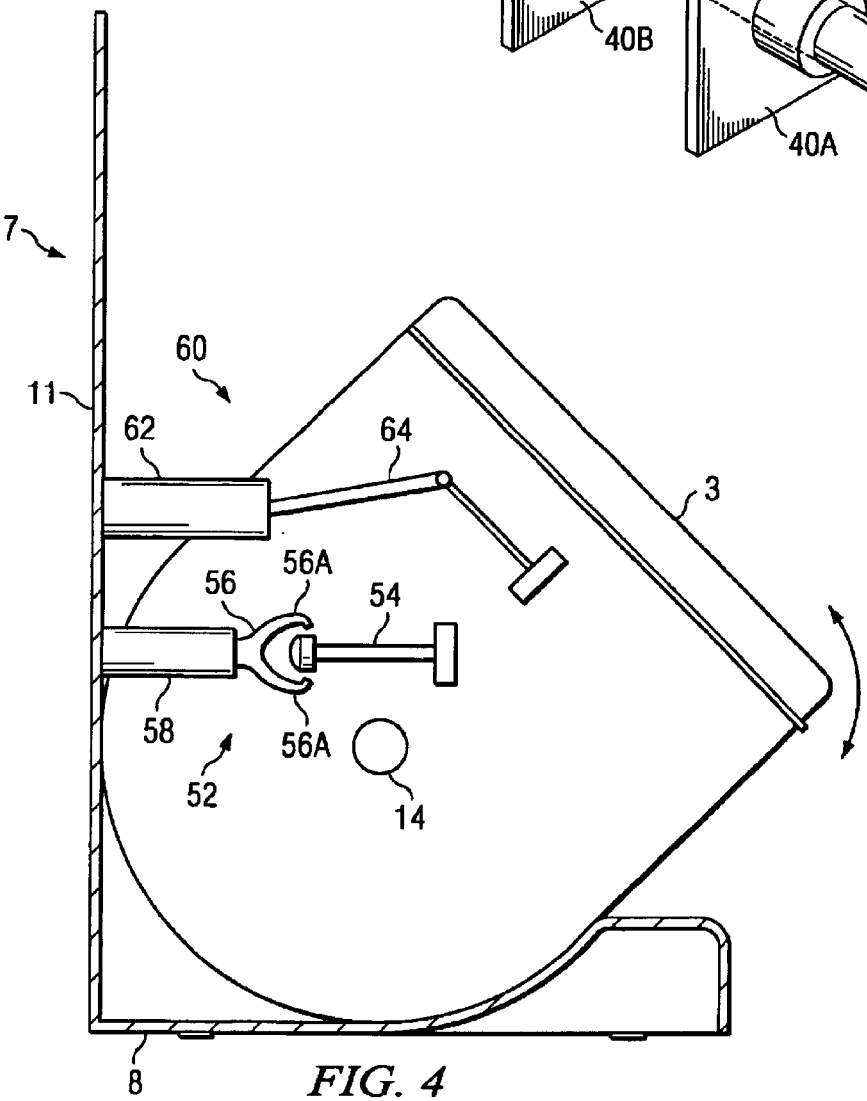
FIG. 4 is a cross-sectional side view of an open/close mechanism of the knife block of FIG. 1.
Figure 5A:
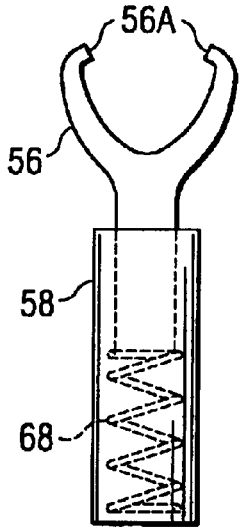
FIGS. 5A and 5B further illustrate a portion of the open/close mechanism of the knife block of FIG. 1.
Figure 5B:
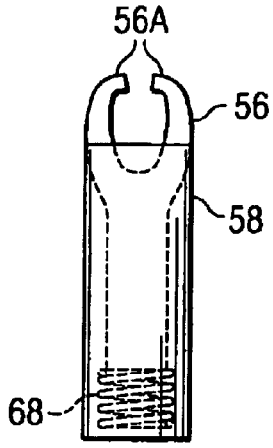

Specifically, the open/close mechanism may include a spring-based latch unit 52 for selectively latching block member 3 to housing 7. Referring to FIG. 4, latch unit 52 may include a male latch member 54 attached to one of block member 3 and housing 7, a female latch member 56 attached to the other of the block member 3 and housing 7, and a spring latch component 58 coupled to female latch member 56. Female latch member 56 cooperates with spring latch member 58 such that female latch member 56 may be in a first position in which the outer tongs 56A of female latch member 56 extend outwardly from spring latch member 58 (FIG. 5A), and a second position in which the outer tongs 56A are at least partly disposed within spring latch member 58 (FIG. 5B). When in the second position, the tongs 56A of female latch member 56 are urged resiliently inwardly towards each other by the sides of spring latch member 58. As a result, tongs 56A of female latch member 56 are capable of grasping male latch member 54 when in the second position, but are incapable of grasping male latch member 54 when in the first position.

It is understood that the particular location of latch unit 52 (male latch member 54, female latch member 56 and spring latch member 58) may be located at positions along housing 7 and block member 3 other than the location depicted in FIG. 4. For instance, latch unit 52 may be disposed along an upper portion of housing 7 and block member 3 so that block member 3 may be coupled in the upright position near the top thereof.

The relationship between female latch member 56 and spring latch member 58 is such that female latch member 56 moves between the first and second positions upon consecutive instances of female latch member 56 being urged inwardly towards spring latch member 58, such as by male latch member 54. For instance, temporarily urging female latch member 56 towards spring latch member 58 may couple female latch member 56 thereto so that female latch member 56 may not be urged outwardly, by a spring 68 in spring latch member 58, beyond the second position. Subsequent temporary urging, such as by male latch member 54, of female latch member 56 towards spring latch member 58 may decouple female latch member 56 from spring latch member 58 so that the spring 68 in spring latch member 58 urges female latch member 56 towards the first position. The structural relationship between female latch member 56 and spring latch member 58 may be any of a number of different implementations, including: a conventional ink pen structure having a rotating sleeve for selectively moving the ink-dispensing point of the pen to and from an outward position for writing; a conventional cassette deck door structure for closing and opening the door of the cassette deck; etc.

Figure 6A:
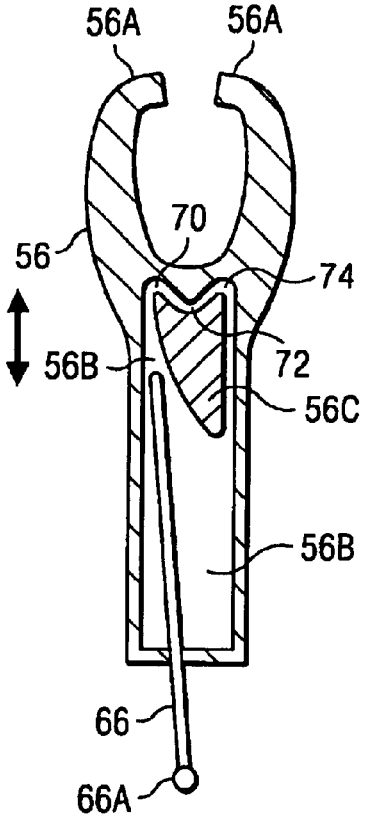
FIGS. 6A and 6B still further illustrate a portion of the open/close mechanism of the knife block of FIG. 1.
Figure 6B:
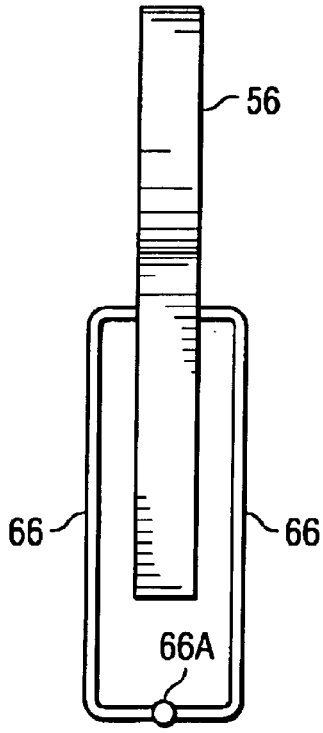

FIGS. 6A and 6B illustrate the structure of female latch member 56 and spring latch member 58 according to an exemplary embodiment of the present invention. Female latch member 56 may include a cam member 56C extending outwardly from one or more opposed sides thereof. Each cam member 56C defines a channel 56B along each of the opposed sides of female latch member 56. Spring latch member 58 may include a substantially U-shaped pin member 66 that is pivotally attached to spring latch member 58 at pivot point 66A. Spring 68 may be disposed between female latch member 56 and spring latch member 58 and serve to force female latch member 56 away from spring latch member 58.

Each prong of U-shaped pin member 66 traces corresponding channel 56B defined by cam member 56C as female latch member 56 is moved within spring latch member 58 in successive inward movements. In a first movement, a prong of U-shaped pin member 66 member may be forced to the top of cam member 56C at point 70, after which spring 68 forces female latch member 56 outwardly from spring latch member 58 so that the prong rests at point 72 along cam member 56C. This rest position represents the above-described second position in which the female latch member 56 grasps the male latch member 54. In a second, subsequent movement of female latch member 56, each prong of pin member 66 may be forced to a second top of cam member 56C at point 74, after which spring 68 forces female latch member 56 outwardly so that the prong rests in the channel at the base of cam member 56C. This rest position represents the above-described first position in which the female latch member 56 extends more outwardly from spring latch member 58 and no longer grasps the male latch member 54. By repeatingly urging female latch member 56 temporarily inwardly towards spring latch member 58 in this fashion, female latch member 56 alternatingly couples and decouples from male latch member 54, and thereby locks and unlocks block member 3 from housing 7, respectively.

Latch unit 52 may further include a hydraulic member 60 (FIG. 4) coupled to housing 7 and to block member 3. Hydraulic member 60 is adapted to push block member 3 from the upright position to the extended position when block member 3 is not locked or latched to housing 7. Hydraulic member 60 may include a sealed compartment 62, a piston (not shown) linearly movable therein, and a piston rod 64 attached to the piston. The sealed compartment 62 may be coupled to one of block member 3 and housing 7, and piston rod 64 may be coupled to the other one of block member 3 and housing 7. Sealed compartment 62 is coupled to the back 11 of housing 7 and piston rod 64 is coupled to a side of block member 3 in FIG. 4 for exemplary purposes only. It is understood that, alternatively, the coupling to block member 3 may be to the back thereof.

Movement of block member 3 relative to housing 7 moves piston rod 64 and the piston within sealed compartment 62, and thereby changes the fluid pressure therein. The fluid pressure in sealed compartment 62 is utilized to move block member 3 from the upright position to the extended position.

It is understood that knife block 1 may utilize other biasing mechanisms to bias or push block member 3 to the extended position. For instance, knife block 1 may utilize a spring member for biasing block member 3.

The use of knife block 1 will be described with reference to FIGS. 1–6. Initially, it is assumed that block member 3 is in the extended position, as shown in FIG. 1 and in dashed lines in FIG. 2. In this position, surface 3A of block member 3 extends sufficiently from housing 7 so that knives may be easily inserted in block member 3 or withdrawn therefrom. Male latch member 54 is decoupled from female latch member 56 in the extended position. By urging block member 3 inwardly by hand or finger applied pressure, block member 3 pivots about pivot axle 14 towards the upright position. The pivoting movement of block member 3 causes piston rod 64 to be moved within sealed compartment 62 so as to build fluid pressure therein. Around the point where block member 3 is in the upright position, male latch member 54 contacts and urges female latch member 56 inwardly towards spring latch member 58 so that female latch member 56 is latched in the second position (FIG. 5B). Prongs of pin member 66 are positioned at points 72 of cam members 56C in this second position in which tongs 56A of female latch member 56 are urged closer together. In the second position, female latch member 56 grasps male latch member 54 so that the fluid pressure build-up is unable to pivot block member 3 away from housing 7.

At this point, block member 3 is maintained in the upright position and knives cannot be easily removed from knife block 1. Lock mechanism 30 may be optionally activated to lock block member 3 in the upright position, by urging actuator 32 inwardly while rotating actuator 32 until post member(s) 34 engages with slot(s) 36A of bracket 36. Actuator 32 is manipulated in this way by finger or hand applied pressure. Once post member(s) 34 is engaged with slot(s) 36A, the finger or hand applied pressure may be released from actuator 32. Block member 3 is now locked in the upright position.

To unlock block member 3 from the upright position, actuator 32 may be urged inwardly while rotating it in the opposite direction to disengage post member(s) 34 from slot(s) 36A. Block member 3 may be subsequently placed in the extended position by temporarily urging block member 3 slightly inwardly with hand or finger applied pressure so that upon release of the pressure, spring latch member 58 no longer maintains female latch member 56 in the second position. At this point, prongs of pin member 66 are moved from point 72 to point 74 and then to the base of cam member 56C corresponding to the first position (FIGS. 5A and 6A) When in the first position, female latch member 56 disengages from male member 54 (due to the tongs 56A of female latch member 56 resiliently spreading apart), thereby allowing block member 3 to pivot about pivot axle 14. Releasing the hand/finger applied force on block member 3 allows hydraulic member 60 to pivot block member 3 towards the extended position, due to the fluid pressure build-up in hydraulic member 60. Once in the extended position, the top surface 3A of block member 3 is substantially entirely exposed, thereby allowing for easy withdrawal or insertion of a knife therein.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A utensil holder, comprising:

a block member having at least one slot disposed along a top surface thereof for receiving a portion of a hand tool therein;

a housing member to which the block member is pivotally attached along a transverse pivot axis so that the block member may be moved between an upright position in which the top surface of the block member is positioned substantially within the housing and an extended position in which the top surface of the block member extends from the housing at a predetermined angle; and a lock mechanism for selectively locking the block member in the upright position.

2. The utensil holder of claim 1, wherein a bottom surface of the block member has a convex, curved shape, and the housing including a base portion having a concave, curved surface opposed to the bottom surface of the block member.

3. The utensil holder of claim 2, wherein the housing comprises at least one side member that extends from the base portion at approximately a right angle therewith, and a top member that extends over the top surface of the block member when the block member is in the upright position.

4. The utensil holder of claim 1, wherein the lock mechanism comprises an actuator operatively coupled to the block member such that manipulation of the actuator by finger-applied pressure prevents movement of the block member from the upright position.

5. The utensil holder of claim 4, wherein the housing comprises at least one side member and the actuator is disposed along an exposed surface of the at least one side member.

6. The utensil holder of claim 4, further comprising at least one axle about which the block member rotates, and the lock mechanism further comprises at least one post member that extends from the at least one axle, and a bracket member that is affixed to the housing member and includes at least one slot with which the at least one post member selectively engages.

7. The utensil holder of claim 6, wherein the lock mechanism further comprises a spring member substantially coaxially aligned with the at least one axle and adapted to resist axial movement of the at least one axle into the utensil holder.

8. The utensil holder of claim 1, wherein the utensil holder comprises a knife holder.

9. The utensil holder of claim 1, further comprising a mechanism for selectively latching the block member in the upright position and for pivoting the block member towards the extended position.

10. The utensil holder of claim 9, wherein the mechanism for latching and pivoting couples the block member to and decouples the block member the housing member by temporarily urging the block member relatively slightly inwardly towards the housing member.

11. The utensil holder of claim 10, wherein the mechanism for selectively latching and pivoting comprises a bias mechanism for biasing the block member towards the extended position.

12. A knife block, comprising:

a first member for holding one or more knife blades therein;

a second member to which the first member is pivotally attached, the first member being selectively pivoted about the second member such that the first member is selectively moved between a first position in which the first member holds the one or more knife members in a substantially vertical position and a second position in which the first member holds the one or more knife members in an angular position between a vertical position and a horizontal position; and an open/close mechanism to selectively move the first member from the first position to the second position in a controlled manner following the first member being decoupled from the second member, and to selectively couple the first member to the second member while in the first position.

13. The knife holder of claim 12, wherein the second member comprises a housing to which the first member is pivotally attached, such that in the first position a top surface of the first member is positioned within the housing, and in the second position the top surface of the first member extends forwardly of the housing.

14. The knife block of claim 12, further comprising a lock mechanism coupled to the first member for preventing movement of the first member from the first position.

15. The knife block of claim 14, wherein the second member comprises a housing, the first member is disposed substantially within the housing when in the first position.

16. The knife block of claim 15, wherein the lock mechanism comprises an actuator disposed along a side of the housing.

17. The knife block of claim 12, further comprises at least one axle about which the first member pivots, and wherein the lock mechanism further comprises an actuator coupled to the at least one axle, at least one post member that extends from the at least one axle, and a bracket member coupled to the second member and including at least one slot that selectively engages with the at least one post member.

18. The knife block of claim 17, further comprising at least one spring member coupled to the actuator so as to substantially resist inward movement thereof.

19. The knife block of claim 12, wherein the first member has a bottom portion having a rounded, convex surface, and the second member includes a base having a rounded, concave surface positioned forwardly of the substantially rounded, convex surface of the first member.

20. The knife block of claim 12, wherein the open/close mechanism comprises a latch mechanism comprising a male member coupled to one of the first member and the second member, a female member coupled to the other of the first member and the second member, and a latch member for causing the female member to selectively couple to the male member.

21. The knife block of claim 20, wherein the female member couples the male member thereto upon the female member being temporarily pivoted inwardly a first time, and decouples from the male member upon the female member being temporarily pivoted inwardly a second time following the first time.

22. The knife block of claim 21, wherein the open/close mechanism further comprises a pin member associated with the latch member and a cam member associated with the female member, for controlling movement of the pin member.

23. The knife block of claim 21, wherein the open/close mechanism further comprises a spring member coupled to the female member and the latch member.

24. A utensil bolder, comprising:

a block member having at least one slot disposed along a top surface thereof for receiving a portion of at least one hand tool therein;

a housing member to which the block member is pivotally attached along a transverse pivot axis so that the block member may be moved between an upright position in which the top surface of the block member is positioned substantially within the housing and an extended position in which the top surface of the block member extends from the housing at a predetermined angle; and an actuator disposed along a side of the housing and operatively coupled to the block member for selectively locking the block member in the upright position.

25. The utensil holder of claim 24, wherein the means for selectively locking further comprises at least one post member coupled to the actuator such that rotational movement of the actuator causes movement of the least one post member, and a bracket member coupled to the housing member and including at least one slot to which the at least one post member selectively engages.

26. The utensil holder of claim 24, wherein the utensil holder is a knife holder and the at least one hand tool comprises a knife.

27. The utensil holder of claim 24, wherein the block member includes a bottom portion having a convex, curved surface and the housing member includes a base having a concave, curved surface coinciding with the convex, curved surface of the block member such that the convex, curved surface of the block member is adjacent the concave, curved surface of the base when the block member is moved between the upright position and the extended position.

28. The utensil holder of claim 24, further comprising a means for selectively moving the block member from the upright position to the extended position, and for selectively latching the block member in the upright position.

29. The utensil holder of claim 28, wherein the means for selectively moving and selectively latching comprises a male member coupled to one of the block member and the housing member, a female member coupled to the other of the block member and the housing member, and a latch member for causing the female member to selectively couple to the male member.

30. The utensil holder of claim 29, wherein the female member couples the male member thereto upon the female member being temporarily pivoted inwardly a first time, and decouples from the male member upon the female member being temporarily pivoted inwardly a second time following the first time.

31. The utensil holder of claim 30, wherein the open/close mechanism further comprises a pin member associated with the latch member and a cam member associated with the female member, for controlling movement of the pin member.

* * * * *

UNITED STATES PATENT AND TRADEMARK OFFICE

CERTIFICATE OF CORRECTION

PATENT NO. : 6,920,987 B2
DATED : July 26, 2005
INVENTOR(S) : Jeffrey Siegel et al.

It is certified that error appears in the above-identified patent and that said Letters Patent is hereby corrected as shown below:

Column 2,
Lines 65-66, replace "Cover may be" with -- Cover 10 may be --.

Column 9,
Line 1, replace "A utensil bolder," with -- A utensil holder, --.

Signed and Sealed this

Fourth Day of April, 2006

JON W. DUDAS
*Director of the United States Patent and Trademark Office*